US009222233B2

(12) United States Patent
Peters

(10) Patent No.: US 9,222,233 B2
(45) Date of Patent: Dec. 29, 2015

(54) METHOD AND DEVICE FOR CREATING AN UNDERWATER FOUNDATION OF A BUILDING

(75) Inventor: Marc Peters, Freiburg (DE)

(73) Assignee: Herrenknecht AG, Schwanau (DE)

( * ) Notice: Subject to any disclaimer, the term of this patent is extended or adjusted under 35 U.S.C. 154(b) by 20 days.

(21) Appl. No.: 13/322,848

(22) PCT Filed: Apr. 7, 2010

(86) PCT No.: PCT/EP2010/002181

§ 371 (c)(1),
(2), (4) Date: Nov. 28, 2011

(87) PCT Pub. No.: WO2010/139380

PCT Pub. Date: Dec. 9, 2010

(65) Prior Publication Data

US 2012/0076591 A1 Mar. 29, 2012

(30) Foreign Application Priority Data

Jun. 2, 2009 (DE) ..... 10 2009 023 466

(51) Int. Cl.

| | |
|---|---|
| ***E02D 7/00*** | (2006.01) |
| ***E02D 7/20*** | (2006.01) |
| ***E02D 7/16*** | (2006.01) |
| ***E02D 7/26*** | (2006.01) |
| ***E02D 7/28*** | (2006.01) |
| ***E02D 13/04*** | (2006.01) |
| ***E02D 27/52*** | (2006.01) |

(52) U.S. Cl.

CPC .. *E02D 7/20* (2013.01); *E02D 7/16* (2013.01); *E02D 7/26* (2013.01); *E02D 7/28* (2013.01); *E02D 13/04* (2013.01); *E02D 27/52* (2013.01)

(58) Field of Classification Search

CPC ..... E02D 13/04; E02D 27/52; E02D 7/16; E02D 7/20; E02D 7/26; E02D 7/28; E02D 7/02; E02D 15/08; E21B 7/20

USPC ..... 405/224, 228, 229, 231, 232, 249, 299; 175/5–10; 166/358

See application file for complete search history.

(56) References Cited

U.S. PATENT DOCUMENTS 3,314,240 A * 4/1967 Bardgette ..... 405/228
3,340,928 A * 9/1967 Brown ..... 166/352

(Continued)

FOREIGN PATENT DOCUMENTS

DE 19533281 * 3/1997 ..... E02D 13/08
JP 60144417 * 6/1985 ..... E02D 7/16

*Primary Examiner* — John Kreck
*Assistant Examiner* — Carib Oquendo
(74) *Attorney, Agent, or Firm* — Mark Rodgers

(57) ABSTRACT

The invention relates to a method and a device for creating an underwater foundation of a building, wherein a base element is provided as a module carrier (11) at the erection site and a pile (6) forms the foundation to be created or is a component of the foundation, wherein the pile (6) is implemented as a hollow body. The aim of the invention is to allow the creation of a foundation in geologically difficult conditions, while simultaneously reducing noise emissions in sensitive areas. The aim is achieved by clamping the pile (6) in a pivot module (13), by erecting the pile (6) by way of pivoting the pivot module (13), until the desired driving direction into the ground (9) relative to the horizontal is achieved, by locking the pivot module after erecting the desired slope, by sinking the pile (6) to the floor (8) of the water system (7) and pressing it into the floor (8) until a limit value of a driving force is reached, by installing a sinking device (24) in the pile (6) and sinking it to the floor (8), by loosening the rock (9) below the pile (6) and sinking the pile (6) until the final depth is reached.

15 Claims, 3 Drawing Sheets

(56) References Cited

Figure 1:
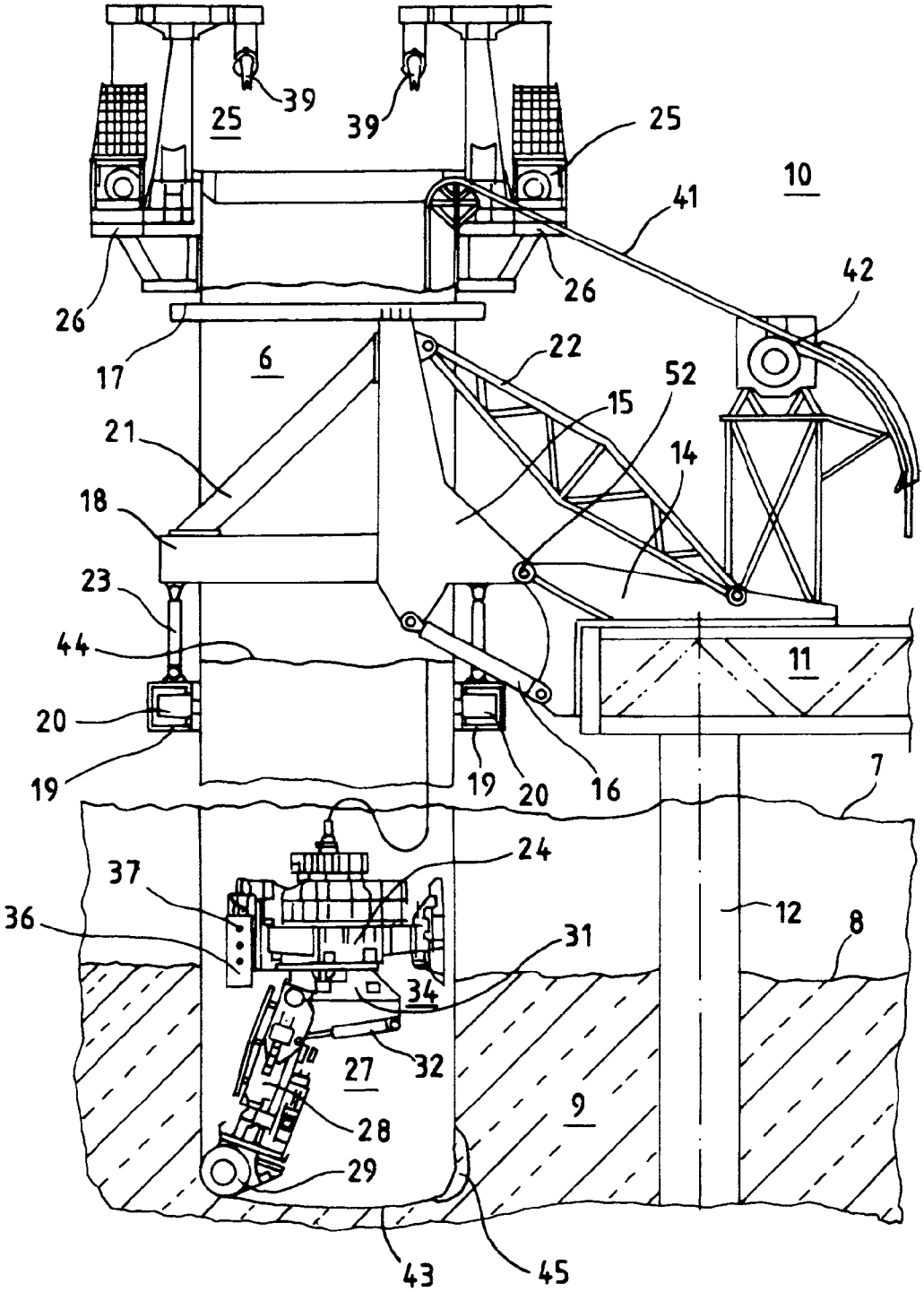

U.S. PATENT DOCUMENTS 3,980,145 A * 9/1976 Wibom ..... 175/65
4,744,698 A * 5/1988 Dallimer et al. ..... 405/226
4,904,119 A * 2/1990 Legendre et al. ..... 405/228
5,012,875 A * 5/1991 Casbarian et al. ..... 175/9
8,517,639 B2 * 8/2013 Gibberd et al. ..... 405/227

* cited by examiner

METHOD AND DEVICE FOR CREATING AN UNDERWATER FOUNDATION OF A BUILDING

The invention relates to a method and a device for creating an underwater foundation of a construction and to a pivot device as a component part of said device. A base element is here provided as a module carrier at the erection site and a pile is provided, which pile forms the foundation to be created or is a component part of the foundation, wherein the pile is realized as a hollow body.

In the erection of constructions which base their foundations on ground which is below water, these foundations are produced in different ways, the use of so-called monopiles having become prevalent in the case of single-part foundations. An alternative thereto is the so-called jacket, which is constituted by a so-called pyramidal structural element having several foundation points. Such constructions are constituted, for instance, by wind power plants or by bridge constructions.

According to the prior art, in the case of monopiles, so-called jack-up rigs, for instance, are provided at the erection site, the working plane of which jack-up rigs is provided with a swing gear. The pile is clamped into this swing gear, is redirected from the horizontal into the vertical and is let down onto the sea floor by opening of the clamps. The pile is then driven into the ground by means of pile driving gear.

A drawback of this foundation method is the dependence on the local geology. If the ground is provided with components which prove to be undrivable, for instance as a result of solid rock or the presence of layers of clay in which friction rises too strongly, or the presence of rock fragments or the like, then this method cannot be used. Another drawback with this method is, particularly in ecologically sensitive regions, that high noise emissions emanate from this method.

The object of the invention is therefore to provide a method and a device with which foundations can be created from individual piles in geologically difficult conditions. At the same time, these should be usable even in ecologically sensitive regions.

With respect to the method, the object according to the invention is achieved by virtue of the fact that the pile is clamped into a pivot module, that the pile is erected by the pivot module being pivoted until the desired driving direction into the ground in relation to the horizontal is achieved, that the pile is set down onto the floor of the water system and is pushed into the floor until a limit value of the feed force is reached, that a sinking device is installed in the pile and is lowered onto the floor, that the rock beneath the pile is loosened and the pile is lowered until a final depth is reached.

Through the provision of a sinking device which is adaptable to the respective ground conditions, it becomes possible to use hollow piles as foundations in non-drivable soils. At the same time, the active lowering of the pile and the loosening of the rock by the sinking device eliminates the environmental noise pollution which is generated by the pile driving.

A further teaching of the invention provides that the base element is a jack-up platform, a pontoon and/or a ship. It is hereby possible to provide a suitable basis for the implementation of the method in dependence on the water system.

A further teaching of the invention provides that the pivot module is locked in place once the desired inclination is reached. A higher accuracy is hereby achieved.

A further teaching of the invention provides that the pile is realized as a cylinder or a cuboid. These forms are advantageous with respect to the creation of the foundation and the introduction of the pile into the ground. It is further provided that the pile has an inner diameter starting from 4 m and larger, diameters of 11 m or more being achievable.

A further teaching of the invention provides that the feed force is generated via at least one feed element disposed on the pivot module, preferably a hydraulic cylinder. Hence the necessary feed force can be provided in a simple and direct manner directly on the pile connected to the pivot module and an additional driving device, such as is represented, for instance, by the pile driving tool, can be dispensed with.

A further teaching of the invention provides that at least one winch for raising and lowering the sinking device is provided, so that direct controlling of the winch with respect to the position within the pile is possible. Particularly preferably, the winch is provided directly above the pile, particularly preferably on a platform at the upper end of the pile, so that no additional installations are necessary on the base carrier.

A further teaching of the invention provides that the inside of the pile is filled with water in order to avoid bearing capacity failure of the base, and that the water level in the pile has the height of the water level of the water system or is higher than this. As a result of this measure, in particular in the case of changeable soils, the bulging-in or caving-in of the base beneath the pillar, and thus the impairment of the feed rate, can be prevented.

A further teaching of the invention provides that, following the sinking, a generated overcut is filled in. An optimal anchorage (insofar as the overcut persists on the outer side of the pile after the pile has been lowered) is hereby achieved.

A further teaching of the invention provides that the sinking is performed fully automatically or manlessly with the sinking device. Vertical shaft boring machines lend themselves to this purpose, which machines preferably operate in partial cut or full cut mode and are provided with boring devices, in which, in dependence on the geology, the cutting tools, such as, for instance, boring bits or paring blades, interchange and can be adapted to the given conditions.

The inventive achievement of the object provides, with respect to the device, that this is provided with a base element as the module carrier, wherein a pivot module, with which the pile can be pivoted, is disposed on the base element, wherein a feed module for lowering the pile is provided on the pivot module, and a locking mechanism for locking in place the pivot module is provided. In addition, a sinking module, which is disposed within the pile, and at least one lifting module, for lowering/raising the sinking module, are provided in the pile. As a result of such a device, an adaptation to given geologies can easily be performed and the environmental effects, the noise emission and the like can be reduced.

Preferably, the base element, as a module carrier, is constituted by a jack-up platform, a pontoon and/or a ship. It is additionally advantageous that the pile is realized as a cylinder or cuboid, and that the inner diameter of the pile has 4 m or more, diameters of 11 m or more being technically feasible. It is further advantageous that on the pivot module is disposed a feed element, which is preferably constituted by a hydraulic cylinder, whereby it becomes possible to let down the pile in the pivot module in a controlled manner and press it into the ground, insofar as the generated feed force does not exceed defined parameters. Advantageously, the loose rock which is hereupon generated and which is present inside the pile is discharged by means of dredges and flushing pumps. For the raising and lowering of the sinking device, at least one winch is preferably provided on a platform, particularly preferably directly in the upper end region of the pile.

A further teaching of the invention provides that the sinking device is a partial cut or full cut device, which particularly preferably is realized as a shaft boring machine. Preferably, this is designed to be fully automatic or manless during the sinking operation. In dependence on the geology, the tools for loosening the rock are adapted, with the use of boring bits or paring blades.

A further teaching of the invention provides that the sinking device has at least one locking mechanism with respect to the inner wall of the pile, and that the sinking device can move with the sinking tool, and/or in its entirety, relative to the locking mechanism toward the base. The tooling times of the sinking device during the sinking operation are hereby reduced.

As an element for the achievement of the inventive object, a pivot device for pivoting a pile in the creation of an underwater foundation is provided, comprising a carrier element, which is disposed on a base element of the erection device, comprising a pivot body, which is connected to the carrier element by a pivot bearing and at least one feed element, wherein a guide element for the pile and a holding ring having at least one holding element, disposed on the holding ring, for locking in place the pile are provided on the pivot body, and comprising a second holding ring, which is provided with at least one holding element for locking in place the pile, which pile is connected to the pivot device by at least one feed element such that the pile is movable in relation to said pivot device.

As a result of the pivot device, which is provided with a feed element, and as a result of the holding elements on two different portions of the pivot device, it becomes possible to control the lowering of the pile in relation to the pivot device and at the same time, in dependence on the existing geology, to cause the pile to be fed into the ground, whereupon noise emissions resulting from pile driving and the like are eliminated. With the pivot device, it is advantageous if the feed elements are constituted by hydraulic cylinders. The bracing of the holding rings can also be provided by hydraulic cylinders, whereby an adjustment to various diameters is achievable. The base element is preferably constituted by a jack-up platform, a pontoon and/or a ship. The holding elements, which are preferably provided within the holding rings, are preferably hydraulically driven. It is further advantageous that the first and second holding ring are arranged directly one above the other in parallel and are directly connected to each other by the feed element. It is further advantageous that a guide ring is provided at the upper end of the pivot device, and/or that the guide and holding rings have the same cross sections as the pile. Particularly preferably, the pivot device is used in the method according to the invention and in the device according to the invention.

Figure 2:
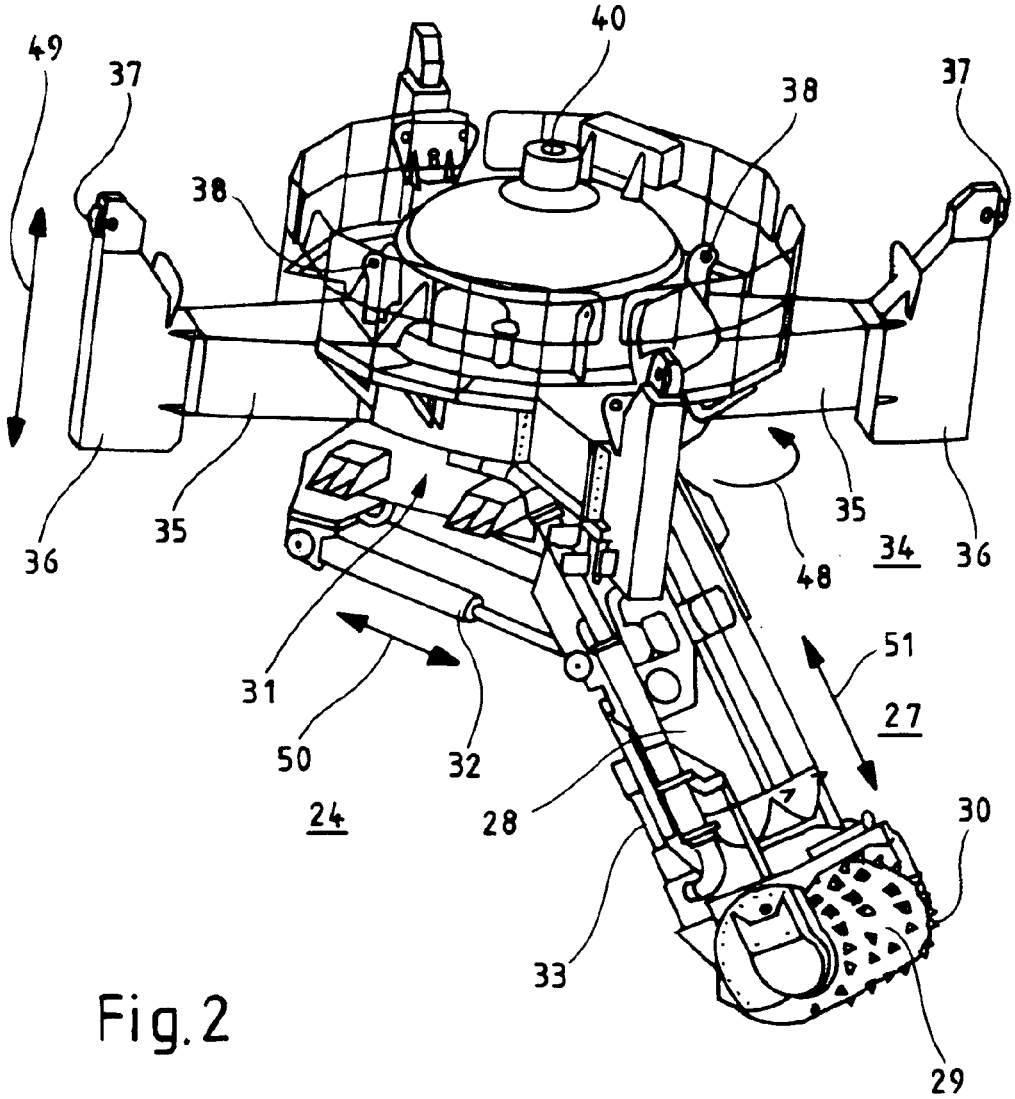
Figure 3:
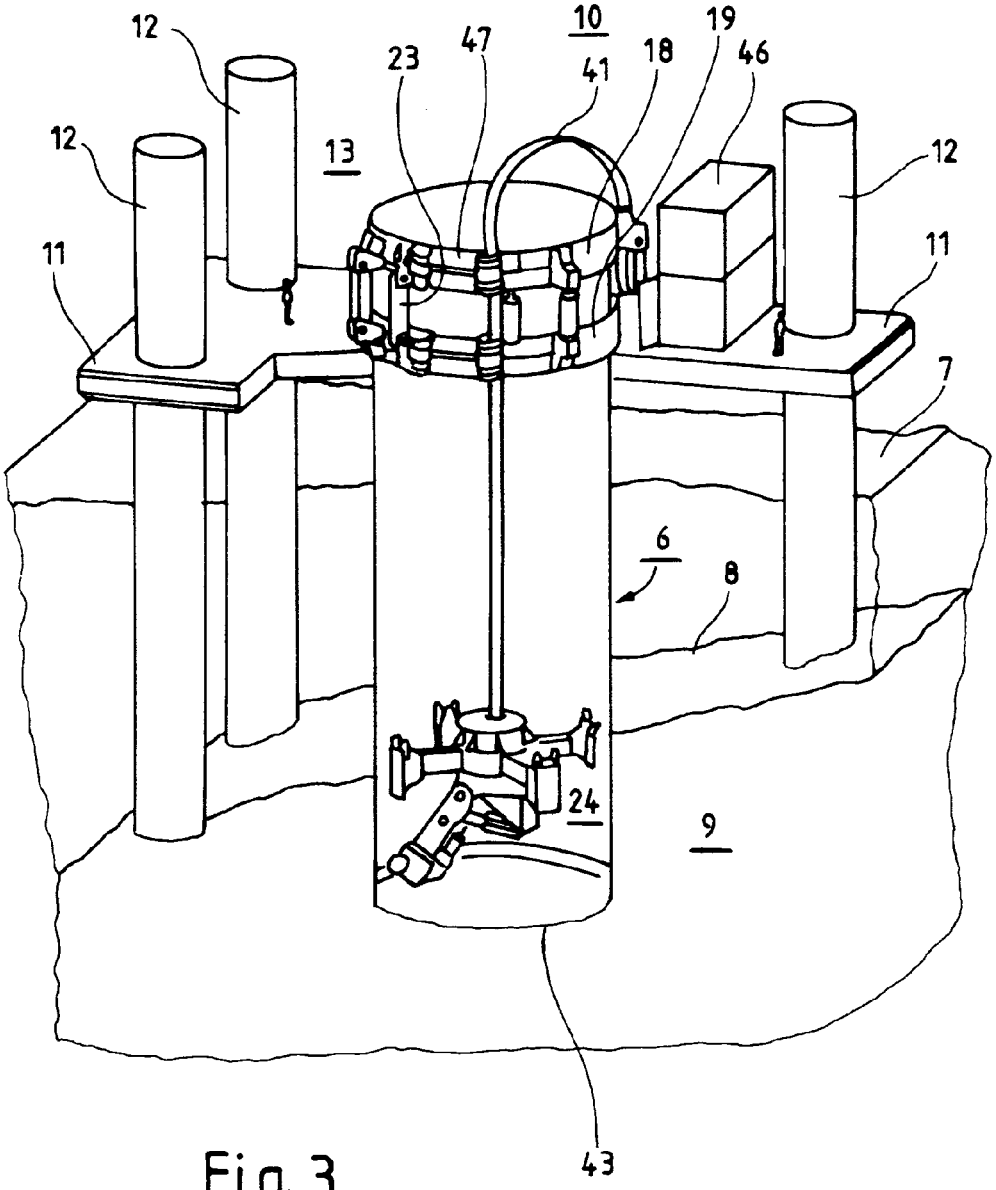

The invention is explained in greater detail below with reference to a preferred illustrative embodiment in conjunction with a drawing, wherein:

FIG. 1 shows a partially sectioned side view of a device according to the invention for use in the implementation of the method according to the invention, FIG. 2 shows a three-dimensional side view of a sinking device according to the invention, and FIG. 3 shows a three-dimensional, partially sectioned side view of a device according to the invention for use in the implementation of the method according to the invention.

FIG. 1 shows a device according to the invention. On a working platform 11, which is connected to the sea floor 8 by stays 12, a pivot module 13 is disposed. The pivot module 13 consists of a carrier element 14, which has a pivot bearing 52. Via the pivot bearing 52, the carrier element 14 is connected to a pivot element 15. In addition, the carrier element 14 is connected to the pivot element 15 by a pivoting cylinder 16, by which the pivot element 15, with a pile 6 disposed in the pivot module 13, can be pivoted out of the horizontal into the vertical. In FIG. 1, the orientation of the pile 6 is vertical. An inclination of the pile 6 relative to the horizontal is likewise possible. Once the desired set-up angle relative to the horizontal is reached, the pivot element 15, with the carrier element 14, is fixed by means of a locking mechanism 22.

On the pivot element 15, at the upper end, a guide ring 17 is disposed. The pile 6 is guided through the guide ring 17 into the pivot module 13. On the pivot element 15 is further provided a first holding ring 18, which, for stabilization purposes, is likewise connected to the pivot element 15 by a diagonal cross member 21. Thus holding ring 18 is fixed to pivot module 13. In the holding ring 18 are disposed holding elements (not represented), by which the pile 6 can be fixed relative to the holding ring 18. Beneath the first holding ring 18 is provided a second holding ring 19, which is connected to the first holding ring 18 by feed elements, pushing cylinders 23. Within the second holding ring 19 are likewise provided holding elements 20, which are hydraulically driven and, when hydraulically loaded, establish a holding connection to the pile 6. Holding ring 18 is shown from the outside and holding ring 19 is shown in cross-section with holding elements 20 shown, but the structure of both holding rings is the same. Both holding rings 18 and 19 comprise holding elements and thus both are clamp-able to an installed pile. For lowering the pile 6 through the pivot module 13, the holding elements in the first holding ring 18 are unfastened, while the holding elements 20 in the second holding ring 19 remain fixed. After this, the pushing cylinders 23 are hydraulically loaded and a corresponding feed force is generated, in the direction of assembly, away from the pivot module 13 onto the pile 6, and the latter is fed or pressed into the ground.

Once the pushing cylinders 23 are fully extended, then the holding elements in the first holding ring 18 are locked in place and the holding elements 20 in the second holding ring 19 are unfastened and the pushing cylinders 23 are retracted, whereby the second holding ring 19 is moved back toward the first holding ring 18. During the extension of the pushing cylinders 23, and thus during the pressing of the pile 6, the generated thrust is monitored to prevent the pile 6 from being pushed too far into the ground 9 and so avoid damage to the pile. It is possible to simultaneously lower the pile 6 over the pivot module 13 by the use of the pushing cylinders 23, while a sinking device 24 disposed in the pile 6 bores out the ground 9 of a base 43 located beneath the pile 6. The holding rings 18, 19 have locking cylinders 47 (see FIG. 3), by which a certain diameter adjustment in relation to the pile 6, and alternatively also a certain pressing of the holding ring onto the pile 6 as an alternative holding element, becomes possible.

FIG. 2 shows a sinking device 24 according to the invention. The sinking device 24 is movably connected to the other apparatus by winches 25, which are located on platforms 26 disposed at the upper end of the pile 6. The winches 25 have a winch hook 39, which engages in corresponding winch stops 38 on the top side of the sinking device 24. Via the winches 25, the sinking device 24 can be raised or lowered vertically within the pile 6. The sinking device 24 has at its upper end a power connection 40, by which a supply line 41 is connected to the sinking device 24. The supply line 41 is connected to a supply winch 42. Via the supply line, the power supply to the sinking device 24 is provided. An evacuation of the loosened rock is also possible via this line.

The sinking device 24 has a sinking unit 27 and a locking unit 34, which are respectively disposed on a main body. The sinking unit 27 has a telescopic arm 28, at the end of which is located a roller 29 bearing the cutting tools 30 disposed thereon. The cutting tools 30 can be constituted by boring bits or paring blades, this arrangement of the respective tools 30 being selected in dependence on the types of rock to be loosened. The telescopic arm 28 has a telescopic cylinder 33, by which the roller 29 can be moved in the telescoping direction 51. Furthermore, the cutting unit 27 has a slewing gear 31. Between the slewing gear 31 and the cutting arm 28 is provided at least one pivoting cylinder 32, which is extensible in the pivoting direction 50 and thus likewise allows movement of the roller 29. The slewing gear 31 allows the roller 29 to be pivoted in the rotational direction 48.

In addition, the cutting device 24 has a locking unit 34, which consists in the present case of four arms 35, at the respective end of which is provided a wall connection 36 with holding elements 37. The holding elements engage in the inner wall of the pile 6. Between the holding element 37 and the wall connection 36, a lowering of the cutting device 24 in the lowering direction 49 is possible, whereby the roller 29 can likewise be moved against the rock.

In order to avoid bearing capacity failure of the base 43, the interior of the pile 6 is filled with water. The fill height here corresponds either to the water level 7 or to the water level in the pile 44. Any overcut 45 which arises following clearance cutting of the base region for the lowering of the pile 6 has to be filled in again after the lowering of the pile 6 to its final depth, unless the rock which is present automatically closes the overcut 45.

On the working platform 11, the power supply units 46 and accommodation quarters for the crews, etc., auxiliary drives, main drives, a possible preparation plant for a drilling fluid which is to be used, for instance, due to the risk of predetermined breaking, are further provided.

The method proceeds as follows: A jack-up platform having a working platform 11 and retractable stays 12 is fitted with a pivot device 13 and the corresponding supply units 46. In addition, a pile 6 is disposed in horizontal arrangement already in the pivot device 13. A sinking device 24, which is constituted by a vertical shaft boring machine, and the associated winches and drive units, is additionally disposed on the jack-up platform. Should further transport capacities in the sense of further piles 6 be necessary, these can be brought via a barge or the like to the jack-up platform installed at the erection site. Following the setting-up and anchorage of the jack-up platform, the pile 6 is inserted into the pivot module 13 and connected thereto. Next the pivot module 13 with the pile 6 is raised by the pivot cylinder 16 about the pivot point 52 into the vertical position, the locking mechanism 22 is installed, the pile 6, with the pushing cylinder 23 and the holding elements 20, is lowered in the first holding ring 18 and second holding ring 19 onto the sea floor 8 and positioned at the erection site of the pile 8. After this, as long as the geology permits or the rock of the sea floor permits, the pile 6 is pressed by means of the feed cylinders 23 into the ground 9. In parallel, the rock component present inside the pile is removed from the pile 6, for instance by a dredge, and either temporarily stored on site or brought to land for dumping. A temporary storage is realized when, following lowering of the pile 6 onto its final position, the inside of the pile 6 is set to be refilled with this material. As the pile 6 is pressed into the ground 9 by the feed cylinders 23, the feed force is monitored. If the generated force exceeds a limit value, the pressing operation is ended and the mechanical driving is initiated by the sinking device 24. For this, the winches 25 are installed on the platforms 26 at the upper end of the pile 6 and the sinking device 24, in the form of a vertical shaft boring machine, is connected up to the winches 25 via the winch hooks 39. In addition, the supply line 41 is connected to the sinking device 24 by the power connection 40. The vertical shaft boring machine is next let down onto the base 43 and the rock 9 in the region of the base 43 is loosened by the rotation of the roller 29 with the boring bits 30. The loosened rock is evacuated from the boring region and, after a separation, is likewise stored or brought to land. By pivoting the roller 29 in the rotational direction 48, telescoping direction 51 and pivoting direction 50, the rock 9 proceeds to be cut. At the same time, the sinking device 24 is lowered in the lowering direction 49. Once maximum lowering is reached, the sinking device 24 is locked in place via the wall connection 36 and the holding element 37 is retracted back into the wall connection 36, so that the lowering can start afresh. Once the final depth of the pile 6 has been reached, the sinking device 24 and the winches 25 are removed. At the same time, the overcut 45, where necessary, is compressed and, also where necessary, the inside of the pile 6 is filled in with the loosened rock or other materials such as concrete. Furthermore, the pivot module 13 is released from the pile 6 and returned to the horizontal. After this, the preparatory measures for the erection of the construction on the thus produced foundation are conducted.

| Reference symbol list | |
|---|---|
| 6 | pile |
| 7 | water level |
| 8 | sea floor |
| 9 | ground |
| 10 | device |
| 11 | working platform |
| 12 | stay |
| 13 | pivot module |
| 14 | carrier element |
| 15 | pivot element |
| 16 | pivot cylinder |
| 17 | guide ring |
| 18 | first holding ring |
| 19 | second holding ring |
| 20 | holding element |
| 21 | diagonal cross member |
| 22 | locking mechanism |
| 23 | pushing cylinder |
| 24 | sinking device |
| 25 | winch |
| 26 | platform |
| 27 | sinking unit |
| 28 | telescopic arm |
| 29 | roller |
| 30 | boring bit |
| 31 | slewing gear |
| 32 | pivot cylinder |
| 33 | telescopic cylinder |
| 34 | locking unit |
| 35 | arm |
| 36 | wall connection |
| 37 | holding element |
| 38 | winch stop |
| 39 | winch hook |
| 40 | power connection |
| 41 | supply line |
| 42 | supply winch |
| 43 | base |
| 44 | water level in pile |
| 45 | overcut |
| 46 | power unit |
| 47 | locking cylinder |
| 48 | rotational direction |
| 49 | lowering direction |
| 50 | pivoting direction |
| 51 | telescoping direction |
| 52 | pivot bearing |

The invention claimed is:

1. A method for creating an underwater foundation of a construction, in which a base element is provided as a module carrier at an erection site and a pile is provided, which pile forms the foundation to be created or is a component part of the foundation, wherein the pile is realized as a hollow body, characterized in that the pile is clamped by at least two clamp-able holding rings into a pivot module, a first holding ring connected to the pivot module and a second holding ring connected to the first holding ring by at least one feed element, and the pivot module is disposed to accept the pile at any angle between horizontal and vertical, in that the pile is erected by pivoting the pivot module until any desired driving direction between horizontal and vertical into a water system floor in relation to horizontal is achieved, in that the pile is lowered onto the water system floor and is pushed into the floor with a feed force produced by the feed element while clamping the second holding ring and unclamping the first holding ring, moving the clamped second holding ring by the travel of the feed element, unclamping the second holding ring on the feed element while clamping the first holding ring and retracting the feed element, repeating for the desired range of motion, with the pile clamped at all times and downward force on the pile controlled; pushing the pile into the floor until at least one of a desired depth is reached or a limit value of a feed force is reached, wherein a sinking device is installed in the pile and is lowered onto the floor, in that rock beneath the pile is loosened and the pile is lowered until a final depth is reached.

2. The method as claimed in claim 1, characterized in that the pile is realized as a cylinder or a cuboid, or that the pile has an inner diameter starting from 4 m.

3. The method as claimed in claim 1, characterized in that the at least one feed element disposed on the pivot module is a hydraulic cylinder.

4. The method as claimed in claim 1, characterized in that at least one winch for raising and lowering the sinking device is provided.

5. The method as claimed in claim 1, characterized in that the inside of the pile is filled with water in order to avoid bearing capacity failure, and in that a water level in the pile is at least equal to a water level of the water system.

6. The method as claimed in claim 1, characterized in that following the sinking, an overcut formed during cutting-out of the rock is filled in.

7. The method as claimed in claim 1, characterized in that the sinking is performed fully automatically or manlessly with the sinking device.

8. The method as claimed in claim 1, characterized in that the sinking device is constituted by a partial cut or a full cut device, or that, for the loosening of the rock, boring bits or paring blades are used.

9. A device for creating an underwater foundation of a construction, comprising a base element, as a module carrier, a pivot module, disposed on the base element, for the erecting and pivoting of a pile at any angle between vertical and horizontal, at least two clamp-able holding rings disposed in line, a first holding ring connected to the pivot module and a second holding ring connected to the first holding ring by at least one feed element for providing a feed force for lowering by sequentially clamping the second holding ring and unclamping the first holding ring, moving the clamped second holding ring by the travel of the feed element, unclamping the second holding ring while clamping the first holding ring and retracting the feed element, repeating for the desired range of motion, keeping the pile clamped at all times and maintaining a controlled force on the pile, and the pile is provided on the pivot module, comprising a locking mechanism configured to lock in place the pivot module and a sinking device which is disposed within the pile, and comprising at least one lifting module for raising/lowering the sinking device is provided in the pile.

10. The device as claimed in claim 9, characterized in that the pile is realized as a cylinder or cuboid, or that the pile has an inner diameter starting from 4 m.

11. The device as claimed in claim 9, characterized in that the at least one feed element disposed on the pivot module is a hydraulic cylinder, by which the feed force for the pile is generated.

12. The device as claimed as claimed in claim 9, characterized in that at least one winch for raising and lowering the sinking device is provided.

13. The device as claimed in claim 9, characterized in that the sinking device is realized such that the sinking operation can be performed fully automatically or manlessly.

14. The device as claimed in claim 9, characterized in that the sinking device is constituted by a partial cut or a full cut device, or that, as tool for loosening the rock, boring bits and/or paring blades are provided.

15. The device as claimed in claim 9, characterized in that the sinking device has at least one locking mechanism with respect to the inner wall of the pile, and in that the sinking device is movable with a sinking tool, and/or in its entirety, relative to the locking mechanism toward the base.

* * * * *